United States Patent [19]

Frankel

[11] Patent Number: 4,893,381

[45] Date of Patent: Jan. 16, 1990

[54] BUNDLING STRAP WITH TWO ADJUSTABLE CLOSURES

[76] Inventor: Eric H. Frankel, 1090 Lanier Blvd., N.E. Atlanta, Ga. 30306

[21] Appl. No.: 165,974

[22] Filed: Mar. 9, 1988

[51] Int. Cl.[4] ..... B65D 63/00

[52] U.S. Cl. ..... 24/16 R; 24/442

[58] Field of Search ..... 24/16 R, 306, 442, 304; 128/DIG. 15, DIG. 26; 604/179, 180; 428/100; 248/205.2; 2/DIG. 11, DIG. 6; 224/901, 250

[56] References Cited

U.S. PATENT DOCUMENTS

| | | | |
|---|---|---|---|
| 3,383,738 | 5/1968 | Fox et al. | 2/DIG. 6 |
| 3,543,977 | 12/1970 | Lockridge | 128/DIG. 15 |
| 3,994,048 | 11/1976 | Rosenthal | 24/306 |
| 4,055,873 | 11/1977 | Kallman | 224/901 X |
| 4,445,894 | 5/1984 | Kovacs | 128/DIG. 26 |
| 4,617,017 | 10/1986 | Hubbard et al. | 128/DIG. 26 |
| 4,671,787 | 6/1987 | Widman | 128/DIG. 26 |

*Primary Examiner*—James R. Brittain
*Attorney, Agent, or Firm*—Vivian L. Steadman

[57] ABSTRACT

A flexible strap for bundling cables, electrical wires or the like comprising two elongated tape segments of differing lengths aligned parallel to each other which are joined together along a transverse seam and which have partially overlapping, releasably interlocking faces with VELCRO® or other hook and loop type attachment means. The free end of the shorter tape segment extends longitudinally past the edge of one end of the longer tape segment. The transverse seam divides the strap so that two separate closures can be formed simultaneously between the interlocking faces. The site for one of these possible closures is at an interface between portions of the interlocking faces on the free end and on a section of the longer tape segment distal the transverse seam. This closure is provided for bundling a cable or the like. The other closure, when formed, is disposed at an interface between portions of the interlocking faces that overlap between the seam and the proximate end of the longer tape segment, enabling one to attach the strap to a single strand of the cable when it is in an unbundled state so that the strap can be readily located when bundling is desired.

3 Claims, 2 Drawing Sheets

Fig. 1.
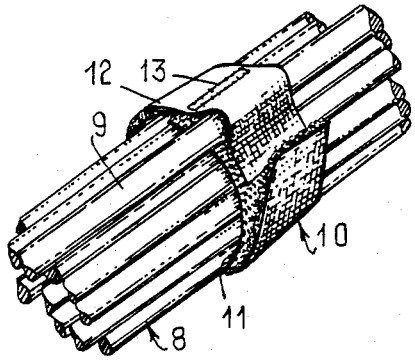
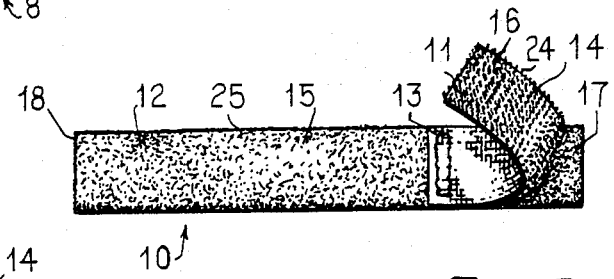
Fig. 2.
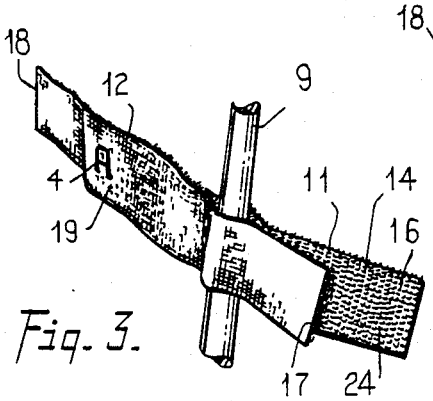
Fig. 3.
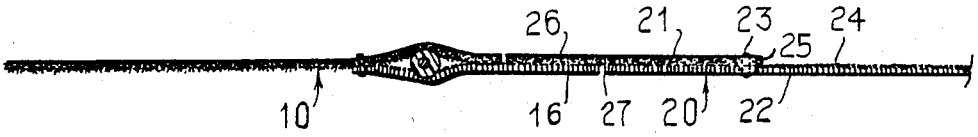
Fig. 4.
Fig. 6.
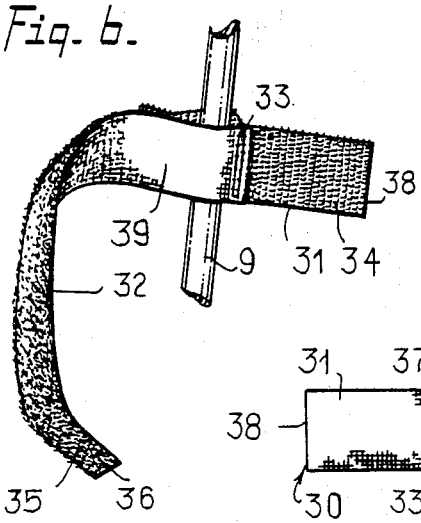
Fig. 5.
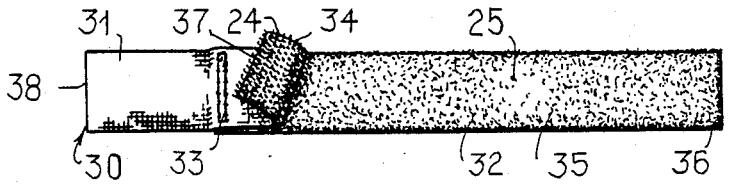

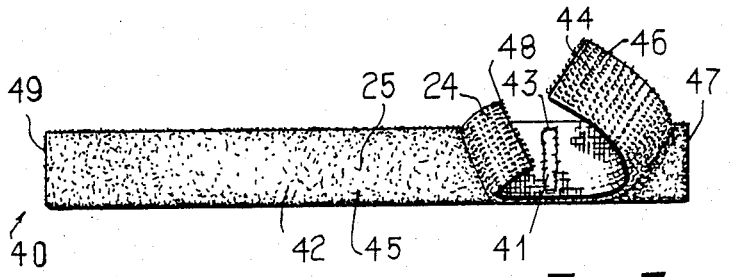
Fig. 7.
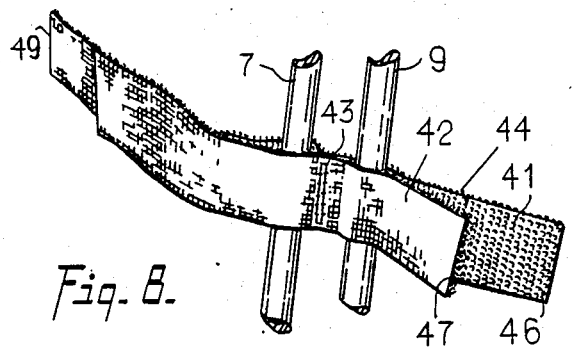
Fig. 8.
Fig. 9.
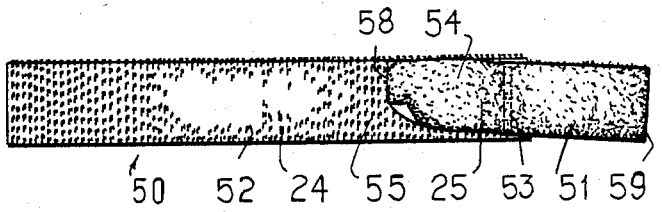
Fig. 10.
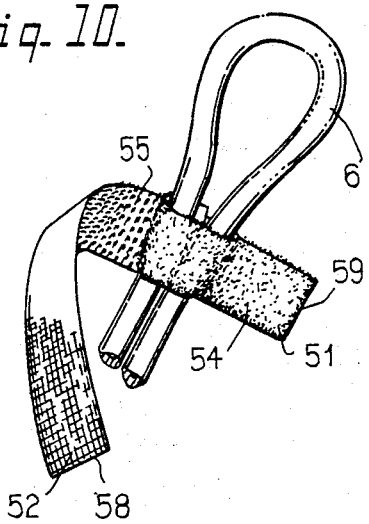
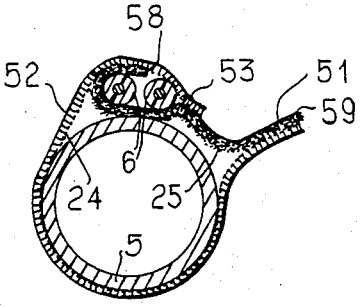
Fig. 11.

BUNDLING STRAP WITH TWO ADJUSTABLE CLOSURES

BACKGROUND OF THE INVENTION

1. Field of the Invention

The present invention relates generally to a reusable bundling strap for coiled electrical cords, wires, cables and the like and more particularly to such a strap which can be removed from a cord, wire or cable without the use of a tool.

2. Description of the Prior Art

Bundling straps which can be reused to secure elongate members, such as a cable, in a bundle with other elongate members, such as in a coil, are known in the prior art. Among these devices are flexible straps having means utilizing the peel-resistant properties of VELCRO ® or other hook and loop type tape for attaching a first portion of the strap to a second portion of the strap. Even though such a strap could, in principle, be used repeatedly to bundle and unbundle elongate members over time, in practice a user frequently experiences difficulty in relocating the strap once it has been removed from the elongate member.

Recognizing the need for a reusable bundling device which is semipermanently attached to an elongate member when it is in an unbundled state, thus eliminating the need to find a bundling device with each intended use, others have offered straps with a "loop" of fixed diameter formed in one end of a peel-resistant tape assembly. Such a loop is then employed to attach the strap to an electrical cord, cable, or the like. But, because the diameter of the loops cannot be adjusted, they are usually oversized for a particular elongate member and tend to slide randomly along it, possibly disengaging themselves altogether from it. Moreover, if a larger diameter device, such as an electric plug, is present which would prevent such a disengagement, the larger diameter device often must be removed before the strap can even be attached to the elongate member, discouraging many potential users.

Fennel in U.S. Pat. No. 4,700,432 discloses a bundling tie having a peel-resistant tape assembly in which, instead of a loop of fixed diameter, the device includes a rachet-toothed tie disposed at one end of this tape assembly. The rachet-toothed tie, although of adjustable diameter so that the device can be readily and securely attached to an elongate member, can only be removed from it either by destroying the tie or with the aid of a tool.

SUMMARY OF THE INVENTION

In accordance with the present invention, there is provided a bundling strap having means for attaching the strap to an elongate member when it is in an unbundled state which is not only adjustable so that the strap can be readily and securely attached to an elongate member but which is also releasable without the aid of a tool.

The improved bundling strap comprises two elongated tape segments of differing lengths aligned generally parallel to each other which have partially overlapping, releasably interlocking faces with VELCRO ® or other hook and loop type attachment means. The two tape segments, each of which has only one such face which occupies one side of the tape segment, are permanently fastened together along a transverse joint. This joint is disposed at one end of only the first tape segment, with the free end of this first tape segment extending longitudinally past the transverse edge of one end of the second tape segment when both tape segments are fully extended, so that two separate closures can be formed simultaneously between the interlocking faces. The site of one of these possible closures is at an interface between portions of the interlocking faces which overlap between the joint and said transverse edge of the second tape segment. This first closure facilitates attaching the strap securely to an elongate member when it is in an unbundled state so that the strap can be readily located when bundling is desired. A second closure, when formed, is disposed at an interface between portions of the interlocking faces on the free end and on a section of the second tape segment situated between the joint and the end of the second tape segment which is distal the transverse edge. The second closure, which is substantially stronger than the first closure, is provided for bundling the elongate member when it is secured to the strap by the first closure.

In a preferred embodiment in which the first tape segment is shorter than the second tape segment, the second closure, when formed, is disposed at an interface between the interlocking faces along a portion of the longer tape segment lying between the end thereof distal the joint and the joint itself. In a preferred embodiment in which the first tape segment is longer than the second tape segment, on the other hand, the second closure, when formed, is disposed at an interface between the interlocking faces situated along a portion of the longer tape segment lying between the end thereof distal the joint and the end of the shorter tape segment which overlaps the longer tape segment to form the first closure.

Further, in both embodiments, the first closure, when formed, is disposed along a section of the strap set back from the end thereof proximate the joint by a distance generally equal in length to the maximum-sized interface between the overlapping portions of the tape segments within the first closure. This novel position of the first closure allows the second closure to be formed anywhere along the portion of the interlocking face of the longer tape segment which is left exposed when the first closure is completed, thereby facilitating the use of the strap to secure a wide variety of elongate members as a tight bundle regardless of the number of strands in the bundle. Moreover, this positioning eliminates any need to wrap either or both ends of the strap multiple times about a bundle of small circumference, creating an ungainly arrangement in the process, in order to complete the second closure.

Further, in an alternate embodiment of the present invention, the transverse joint between the two tape segments is disposed generally in the mid-section of the shorter tape segment with a free end thereof extending longitudinally past the transverse edge of one end of the longer tape segment. The joint is disposed at a distance from said transverse edge which is approximately equal to the distance between the joint and the edge of the end of the shorter tape segment which is distal said free end. Three separate closures can be formed simultaneously between the partially overlapping interlocking faces on the two tape segments. The site of one of these possible closures is at an interface between portions of the faces which overlap between the joint and said transverse edge of the longer tape segment. The site of the second possible closure is at a juxtaposition of portions of the faces which overlap between the joint and said distal edge of the shorter tape segment. The first and second closures facilitate attaching the strap securely to two elongate members when they are in unbundled stated. A third closure, when formed, is disposed at an interface between portions of the interlocking faces on said free end and on the longer tape segment lying between the end thereof distal the transverse edge and the end of the shorter tape segment which overlaps the longer tape segment when the second closure is formed. The third closure, which is substantially stronger than the first and second closures, it provided for bundling one or both elongate members.

A second alternate embodiment includes two elongated tape segments of different lengths aligned generally parallel to each other but having the interlocking face of the shorter tape segment directed away from the interlocking face on the longer tape segment. A transverse joint between the two tape segments is disposed at one end of the longer tape segment and generally along the midsection of the shorter tape segment, giving it two free ends. Two closures can be formed simultaneously at interfaces between the interlocking faces. The first of these closures, when formed, is disposed at an interface between portions of the interlocking faces on the longer tape segment contiguous with the joint and on the first free end of the shorter tape segment. The second closure, when formed, is disposed at an interface between the interlocking faces on the second free end and the longer tape segment and can be completed anywhere along the portion of the interlocking face on the longer tape segment which is left exposed once the first closure is formed. The first closure, which is substantially stronger than the second closure in this second alternate embodiment, is provided for the attachment of the bundling strap to a elongate member in the form of a single loop.

A furher object of the present invention is to provide a bundling strap in which the outer side of the longer tape segment remains viewable when the second closure is formed so that the strap may be used to display on said outer side a message for identification, instructions, advertising or the like.

A still further object of the present invention is to provide a bundling strap that consists merely to two tape segments of VELCRO® or other peel-resistant materials that can be permanently joined together in a simple manner forming the basis for economical mass production of the strap.

BRIEF DESCRIPTION OF THE DRAWINGS

FIG. 1 is a perspective view of an adjustable bundling strap according to the present invention securing a plurality of fragmentary strands of a coiled article;

FIG. 2 is a plan view of the inner surface of the strap shown in FIG. 1, a portion of a tape segment of the strap being folded back for clarity of illustration;

FIG. 3 is a perspective view of the strap shown in FIG. 1 attached to a single fragmentary strand;

FIG. 4 is a side edge view of the strap shown in FIG. 2 as applied to a single strand of coil, the strap being joined to a modification thereof in which the materials forming the peel-resistant surfaces are interchanged from those in the strap shown in FIG. 2;

FIG. 5 is a plan view of an alternate embodiment of the present invention, a portion of a tape segment of the strap being folded back for clarity of illustration;

FIG. 6 is perspective view of the strap shown in FIG. 5 attached to a fragmentary section of a single strand of coil;

FIG. 7 is a plan view of a second alternate embodiment of the present invention, two portions of a tape segment of the strap being folded back for clarity of illustration;

FIG. 8 is a perspective view of the strap shown in FIG. 7 attached to fragmentary sections of two strands;

FIG. 9 is a plan view of a third alternate embodiment of the present invention, a portion of a tape segment of the strap being folded back for clarity of illustration;

FIG. 10 is a perspective view of the strap shown in FIG. 9 attached to a fragmentary section of a loop of a single strand of coil; and FIG. 11 is a side edge view of the strap shown in FIG. 9 attached to a fragmentary section of a loop of a single strand of coil as applied to a cylindrical tube of substantially greater diameter than the coil.

Like reference characters indicate corresponding parts throughout the drawings.

DESCRIPTION OF THE PREFERRED EMBODIMENTS

As illustrated in FIGS. 1-3, a strap 10, embodying the present invention, comprises elongated tape segments 11, 12 and means including peel-resistant faces 14, 15 for releasably interlocking portions of the tape segments by the application of hand pressure. Interengaging hooks 24 and loops 25 project outwardly from the faces 14 and 15, respectively. By preference these hooks and loops are those incorporated in closures sold typically under the trademark "VELCRO" wherein one surface of the closure includes a multiplicity of thin filaments in the form of barbs or hooks and the other surface is made of soft, even thinner filamentary loops, a number of which become intertwinded with the hooks when the surfaces are juxtaposed.

The tape segments 11, 12 which are of generally unequal length are permanently attached to each other along a transverse joint 13. When the longitudinal centerlines of the segments 11, 12 are aligned parallel to each other, the peel-resistant faces 14, 15 partially overlap (FIG. 2). In the preferred embodiment, the segments 11 and 12 measure, by way of example, $2.5 \times 0.75$ inches and $5 \times 0.75$ inches, respectively. The joint 13 is preferably sewn together using a single seam, a double seam, box stitching, or buttonhole stitching. Alternately, the tape segments themselves can be welded ultrasonically or sealed together using a process such as that available commercially under the trademark "VEL-SEAL".

In the preferred embodiment illustrated in FIGS. 1-3, the joint 13 is formed at an end of the shorter tape segment 11 close to one end of the longer tape segment 12 with a free end 16 of the segment 11 extending longitudinally past a transverse edge 17 of said end of the segment 12. The joint 13 so positioned divides the strap 10 so that two closures can be formed simultaneously at interfaces between the faces 14, 15. The site of the first of these possible closures is at a juxtaposition of the loops 25 on a first portion of the face 15 disposed between the joint 13 and the edge 17 and of the hooks 24 on a section of the face 14 situated between the joint 13 and the free end 16. The second closure, on the other hand, is formed when the hooks 24 on the face 14 contiguous with the free end 16 are brought into face-to-face contact with loops 25 on a second portion of the face 15 which are disposed between the joint 13 and the distal end 18 of the segment 12. Because there is a tendency for a user to grasp the free end 16 of the segment 11 upon sandwiching a single elongate member 9 such as an electric wire, cable, tube or the like between the tape segments 11, 12 when creating the first closure, more of said first portion of the longer tape segment 12 is taken up in curving the strap 10 about the member 9 than is taken from the free end 16 in this process. As a consequence, even though the distance between the joint 13 and the proximate edge 17 is generally greater than one-half the length of the shorter segment 11, the portion of the free end 16 available for forming the first closure is typically about one-half the length of the segment 11 once the strap 10 is attached to the member 9 (FIGS. 2 and 3), the effective increase in the length of the exposed face of the free end depending upon the diameter of the member 9.

Even though in a particular application of the strap 10 the interfaces between the faces 14, 15 at the two closures may be similar in area, the second closure is substantially stronger than the first. Indeed, the strength of the second closure is sufficient for restraining a bundle 8 of elongate members 9 in coiled form as illustrated in FIG. 1. The first closure, on the other hand, is best employed to fit the segments 11, 12 about a single elongate member 9 which exerts much weaker forces tending to open the closure. The difference in the strength of the two closures lies in the intrinsic mechanical properties of VELCRO® or of other hook and loop type attachment means: the curved shear strength of such attachment means is many times greater than its peel strength lengthwise with these strengths typically measuring 26.0 p.s.i. and 1.00 p.i.w., respectively. Because the forces exerted by the coiled bundle 8 tend to shear the second closure along a curve pulling the portion of the face 15 situated distal the joint 13 in the opposite direction from the face 14 on the free end 16 along the circumference of the bundle 8, the forces so exerted are resisted by those at the interface of this closure associated with curved shear strength. The forces exerted by the single member 9 on the first closure, on the other hand, are resisted only by the lengthwise peel resistant forces at the interface of the closure. Nevertheless, the strength of the first closure is more than adequate for securing the strap 10 about a single elongate member 9 so that not only is the strap retained thereon but the segments 11, 12 can be fitted with sufficient tightness about the member 9 that the strap has little, if any, tendency to slide along the member, thereby facilitating a user's locating the strap when he wishes to bundle the elongate member. Further, because in forming the first closure, the hooks 24 on the face 14 between the joint 13 and the free end 16 may be attached to any of the loops 25 on the face 15 between the joint 13 and the proximate edge 17, the position of the first closure relative to the joint 13 is continuously adjustable between the joint and points contiguous with the proximate edge 17, thereby providing for a snug attachment of the strap 10 to single elongate members 9 having a wide range of diameters.

Further, the first closure, when formed, is disposed along a section of the strap 10 set back from the edge of the free end 16 by a distance generally equal in length to the maximum-sized interface between the overlapping portions of the tape segments 11, 12 within the first closure. This novel position of the first closure allows the interface between the faces 12, 13 in the second closure to be formed anywhere along the portion of the interlocking face 14 of the longer tape segment 12 which is left exposed when the first closure is completed. Not only does this positioning facilitate the use of the strap 10 to secure a wide variety of elongate members 9 as a tight bundle regardless of the number of strands in the bundle but this positioning also eliminates any ned to wrap either or both ends of the strap 10 multiple times about a bundle of small circumference, creating an ungainly arrangement in the process, in order to complete the second closure. Moreover, this positioning allows the outside 19 of the longer tape segment 12 to remain viewable so that even when the strap is securing a bundle 8, the strap may be used to display a message, indicated generally by the reference numeral 4, such as a graphic symbol "A" on the outer side (FIG. 3).

In the event the circumference of the bundle is too great for a single strap 10 to encircle the bundle, a composite bundling strap comprising a strap 10 and a modified strap 20 is provided (FIG. 4). In the strap 20, tape segments 21, 22 include interlocking faces from which loops 25 and hooks 24 project outwardly. A joint 23 is formed at an end of the shorter tape segment 21 close to one end of the longer tape segment 22 with a free end 26 extending longitudinally past an edge 27 of the segment 22. As illustrated in FIG. 4, loops 25 on the free end 26 are interlocked with hooks 24 on the free end 16 of the strap 10 to form the composite bundling strap.

In the preferred embodiment illustrated in FIGS. 5 and 6, a strap 30 comprises elongated tape segments 31, 32 and means including peel-resistant faces 34, 35 for releasably interlocking portions of the tape segments. The tape segments 31, 32 which are of similar size overall to the tape segments 11, 12, respectively, are permanently attached to each other along a transverse joint 33 similar in construction to the joint 13. When the longitudinal centerlines of the segments 31, 32 are aligned parallel to each other, the peel-resistant faces 34, 35 partially overlap (FIG. 5). The joint 33, however, is formed at one end of the longer tape segment 32 with a free end 36 of the segment 32 extending longitudinally past the edge 37 of the segment 31. The joint 33 so positioned divides the strap 30 so that two closures can be formed simultaneously at interfaces between the faces 34, 35. The first of these possible closures is completed upon a juxtaposition of hooks 24 on a first portion of the face 34 disposed between the joint 33 and the edge 37 and of loops 25 on a section of the face 35 situated contiguous with the joint 33. The second closure, on the other hand, is formed when the hooks 24 on a second portion of the face 34 situated between the joint 33 and the end 38 of the segment 31 which is distal the first closure are brought into face-to-face contact with loops 25 on a portion of the face 35 of the segment 32 which remain exposed, lying between the distal edge of the free end 36 of the segment 32 and the edge 37 of the segment 31, once the first closure is completed. The strap 30 is used similarly to the strap 10 except the first closure cannot be released without first opening the second closure.

As illustrated in FIGS. 7–8, an alternate embodiment combines features of both of the straps 10 and 30. The strap 40 comprises elongated tape segments 41, 42 hooks 24 and loops 25, respectively, for releasably interlocking portions of the tape segments. A transverse joint 43 between the segments 41, 42 is disposed generally in the mid-section of the shorter tape segment 41 with a free end 46 thereof extending longitudinally past the transverse edge 47 at one end of the longer tape segment 42. The joint 43 is disposed at a distance from the transverse edge 47 which is approximately equal to the distance between the joint and the edge 48 of the end of the shorter tape segment 41 which is distal the free end 46. Three separate closures can be formed simultaneously between the partially overlapping interlocking faces 44, 45 on the two tape segments 41, 42. The site of one of these possible closures is at an interface between portions of the faces 44, 45 which overlap between the joint 43 and the transverse edge 47 of the longer tape segment 42. The site of the second possible closure is at a juxtaposition of portions of the faces 44, 45 which overlap between the joint 43 and the distal edge 48 of the shorter tape segment 41. The first and second closures allow a user to attach the strap 40 securely to two elongate members 7, 9 when they are in unbundled states. Alternately, the strap 40 can be attached to a single elongate member such as an electric drill cord and to an article (not shown) which is preferably retained in close proximity to the elongate member, such as a drill chuck key. A third closure, when formed, is disposed at an interface between portions of the interlocking faces 44, 45 on the free end 46 and on the longer tape segment 42 lying between the end 49 thereof distal the joint 43 and the end 48 of the short tape segment 41 which overlaps the longer tape segment 42 when the second closure is formed. The third closure, which is substantially stronger than the first and second closures, is provided for bundling either or both of the elongate members 7, 9.

A further alternate embodiment includes two elongated tape segments 51 and 52 in a strap 50 similar to the tape segments 31 and 32, respectively, in the strap 30 but having loops 25 on an interlocking face 54 of the shorter tape segment 51 directed away initially from the hooks 24 on an interlocking face 55 on the longer tape segment 52 (FIG. 9). A transverse joint 53 between the two tape segments 51, 52 is disposed at one end of the longer tape segment 52 and generally along the mid-section of the shorter tape segment 51, giving it two free ends 58, 59. Two closures can be formed simultaneously at interfaces between the interlocking faces 54, 55. The first of these closures, when formed, is disposed at an interface between portions of the interlocking faces 54, 55 on the longer tape segment 52 contiguous with the joint 53 and on the first free end 58 of the shorter tape segment 51. The second closure, when formed, is disposed at an interface between the interlocking faces 54, 55 on the second free end 59 and the longer tape segment 52 and can be completed anywhere along the portion of the interlocking face 55 on the longer tape segment which is left exposed once the first closure is formed. In the strap 50, the first closure is substantially stronger than the second closure even though in a particular application the interface between the interlocking faces 54, 55 in the second closure may be greater than in the first closure. Indeed, the strength of the first closure, which arises from the curved shear strength of the hook and loop attachment means, is sufficient for restraining a bundled elongate member such as a loop 6. The second closure, on the other hand, is best employed to fit the segments 51, 52 about a single elongate member 5 of large diameter which exerts much weaker forces tending to open the closure. Nevertheless, the strength of the second closure resulting from the lengthwise peel resistant forces acting at the closure is adequate for attaching the strap 50 snugly about the member 5.

What is claimed is:

1. A bundling strap which comprises two elongated tape segments aligned generally parallel to each other and means including partially overlapping peel-resistant faces for releasably attaching the tape segments to each other, the two tape segments being permanently fastened together along a transverse joint, each tape segment having one and only one side thereof covered with a single peel-resistant face, said single peel-resistant face occupying the entire side of the tape segment; the single peel-resistant face of the first tape segment being directed toward the single peel-resistant face of the second tape segment at the transverse joint; the transverse joint being disposed at a first end of the first tape segment and at points between the ends of the second tape segment, the second end of the first tape segment extending longitudinally past a transverse edge disposed at one end of the second tape segment when both tape segments are fully extended longitudinally;

a portion of the peel-resistant face of the first tape segment proximate the transverse joint and a portion of the peel-resistant face of the second tape segment situated between the transverse joint and said transverse edge being adapted to form a first closure; and a portion of the peel-resistant face on the second end of the first tape segment and a portion of the peel-resistant face of the second tape segment situated between the transverse joint and the end of the second tape segment distal said transverse edge being adapted to form a second closure, so that two closures can be formed simultaneously between portions of the peel-resistant faces.

2. The bundling strap according to claim 1 wherein the first tape segment is further characterized as being longer than the second tape segment, the second closure being formable, when the first closure has been formed, along a portion of the longer tape segment situated between the edge of the second end distal the transverse joint and the transverse edge of the shorter tape segment.

3. A bundling strap which comprises two elongated tape segments aligned generally parallel to each other and means including partially overlapping peel-resistant faces for releasably attaching the tape segments to each other, the two tape segments being permanently fastened together along a transverse joint which is disposed asymmetrically with respect to the ends of at least one of the tape segments, each tape segment having one and only one side thereof covered with a single peel-resistant face, said single peel-resistant face occupying the entire side of the tape segment; the single peel-resistant face of the first tape segment being directed toward the single peel-resistant face of the second tape segment at the transverse joint; the transverse joint being disposed at points between the ends of both tape segments, a first end of the first tape segment extending longitudinally past a first transverse edge disposed at one end of the second tape segment when both tape segments are fully extended longitudinally; the other end of the second tape segment extending longitudinally past a second transverse edge disposed on the first tape segment distal said first end when both tape segments are fully extended longitudinally;

a portion of the peel-resistant face of the first tape segment situated between the transverse joint and the first end and a portion of the peel-resistant face of the second tape segment situated between the transverse joint and the first transverse edge being adapted to form a first closure;

a portion of the peel-resistant face of the second tape segment situated between the transverse joint and the longitudinally extending end of the second tape segment and the peel-resistant face of the first tape segment between the transverse joint and the second transverse edge being adapted to form a second closure; and a portion of the peel-resistant face on the longitudinally extending first end of the first tape segment and a portion of the peel-resistant face on the longitudinally extending end of the second tape segment being adapted to form a third closure.

* * * * *